United States Patent [19]

Yuchi et al.

[11] Patent Number: 4,727,359

[45] Date of Patent: Feb. 23, 1988

[54] ANALOG FIRE SENSOR

[75] Inventors: Sadataka Yuchi; Masaki Maruyama, both of Sagamihara, Japan

[73] Assignee: Hochiki Corp., Tokyo, Japan

[21] Appl. No.: 845,572

[22] Filed: Mar. 28, 1986

[30] Foreign Application Priority Data

Apr. 1, 1985 [JP] Japan ..... 60-68863

[51] Int. Cl.[4] ..... G08B 26/00

[52] U.S. Cl. ..... 340/518; 340/505; 340/511; 340/588; 340/870.17; 340/825.08

[58] Field of Search ..... 340/518, 505, 501, 506, 340/511, 514, 588, 589, 870.16, 870.17, 870.21, 825.07, 825.08, 825.11, 825.54

[56] References Cited

U.S. PATENT DOCUMENTS 4,100,542 7/1978 Gallant et al. ..... 340/518

4,254,414 3/1981 Street et al. ..... 340/628

4,536,748 8/1985 Tonello ..... 340/518

4,581,604 4/1986 Kimura et al. ..... 340/521

*Primary Examiner*—Donnie L. Crosland

*Attorney, Agent, or Firm*—Lackenbach Siegel Marzullo & Aronson

[57] ABSTRACT

An analog fire detecting system in which a plurality of sensors produce analog data corresponding to a physical state such as temperature, smoke density, etc. relevant to a fire condition. The values of such analog data are compared with a predetermined threshold level, and if the threshold level is exceeded the analog data is transmitted to a central station in response to a polling signal therefrom. A CPU in the central station determines, from the analog data from the sensors, if there is a possibility of a fire and if so makes a predictive calculation of the remaining time until a fire condition will be reached. An alarm is given when such predicted time falls below a preset interval.

8 Claims, 12 Drawing Figures

ANALOG FIRE SENSOR

FIELD OF THE INVENTION AND RELATED ART

This invention relates to an analog fire sensor for use in a fire alarm system, and more particularly to an analog fire sensor which detects, in the form of an analog amount, the quantity of a state such as a smoke density, a temperature, gas concentration or the like as a result of a fire, transmits the same to a central signal station, and determines a fire condition from the analog data received by the central signal station.

Conventional fire alarm system employ so-called on-off type fire detectors which are adapted to close their contacts when they detect a fire and transmit a fire signal to a central signal station. This conventional fire alarm system, however, can not successfully attain two objectives sought for in a the fire alarm system, such as early detection of a fire and prevention of false alarming.

To solve this problem, there has recently been proposed an analog type fire alarm system wherein an analog amount such as temperature or smoke density as detected by detectors is transmitted as it is to a central signal station, and fire determination is carried out, at the central signal station, on the basis of the detected analog amount.

However, if the detection data from all of the analog fire sensors is taken in and fire determination processing is carried out for each sensor, the duration of each sampling cycle of the sensor data by polling is prolonged as the number of the sensors is increased. In addition, the central signal station is required to carry out complicated fire determination processing and the and CPU of the central signal station becomes busy, so that polling of another sensor must be halted. Thus, the processing load on the by CPU of the central signal station becomes too heavy. As a result, the number of the sensors employable will be restricted.

Furthermore, since the analog data transmitted from the sensors contain fluctuation due to noises, if they are used as such, erroneous fire determination may possibly be made. For this reason, it is necessitated to conduct pre-processing for eliminating undesired noise components contained in the received analog data. This preprocessing further increases the burden on the CPU of the central signal station.

SUMMARY OF THE INVENTION

The present invention is directed to obviating the problems as mentioned above, and it is an object of the present invention to provide an analog fire alarm sensor which comprises an analog sensor section for detecting a quantity of a state such as a temperature, smoke density, etc. in the form of an analog amount, and a comparing section for comparing the value of the analog data output from the analog sensor section with a predetermined sensor threshold value.

In accordance with the present invention, the number of analog fire alarm sensors to be subjected to fire determination by the central signal station is greatly decreased, whereby the burden on the CPU of the central signal station is remarkably reduced. In addition, noises caused within a range lower than a threshold detection level of the sensors can be eliminated.

DETAILED DESCRIPTION OF PREFERRED EMBODIMENT

Figure 1:
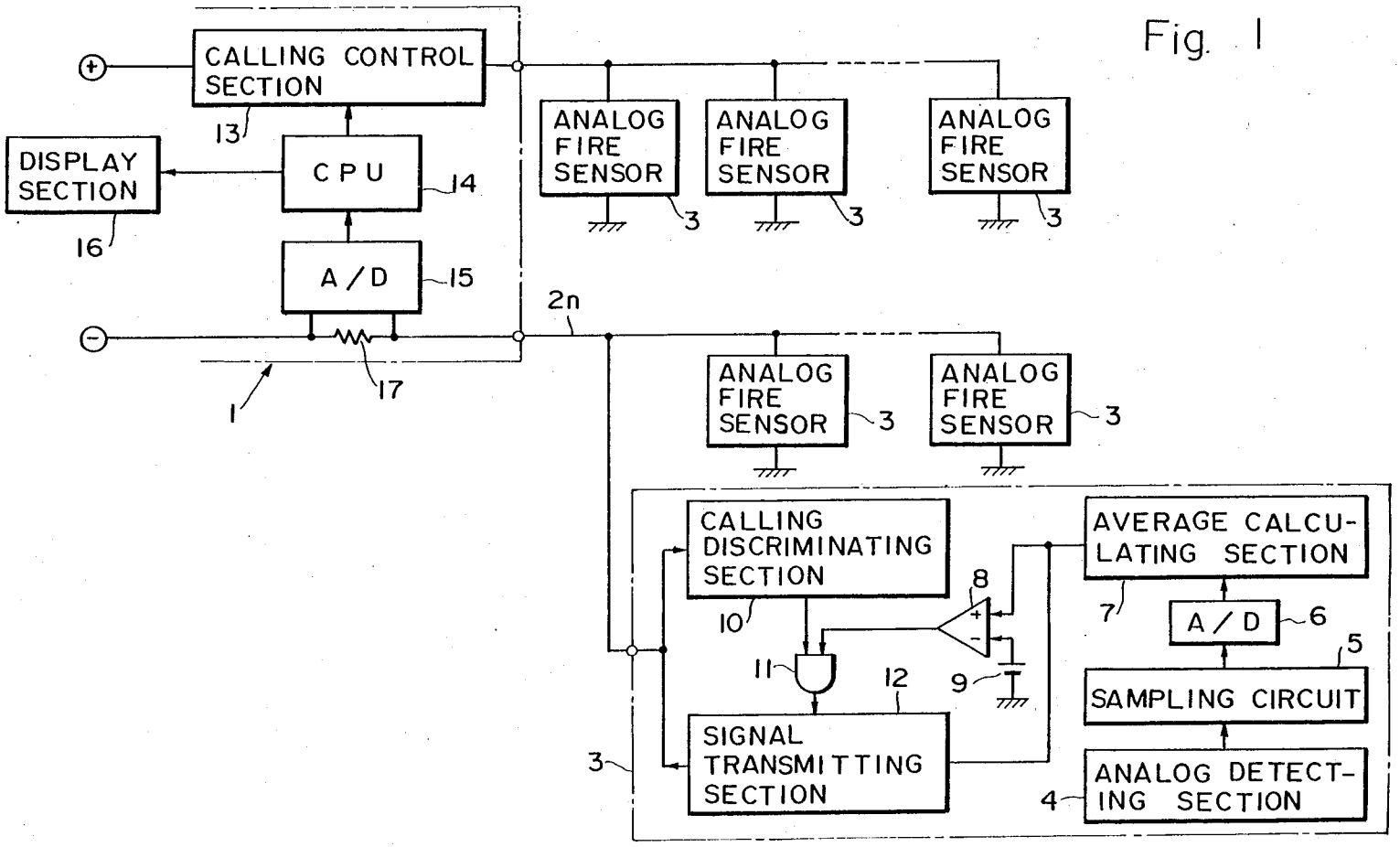
FIG. 1 is a block diagram of a first embodiment of the present invention.

FIG. 1 illustrates a basic formation of a first embodiment of the present invention. A central signal station 1 includes therein CPU 14 which carries out the fire determination processing. Analog fire sensors 3 are respectively connected to signal lines *2a* to *2n* from the central signal station 1. The analog fire sensors 3 detect, in the form of an analog amount, a quantity of state as a result of a fire, such as temperature, smoke density, CO gas concentration, etc., and transmit, for example in an electric current mode, the detection data in response to a polling signal from the central signal station 1.

Each analog fire sensor 3 is operated by power supplied from the central signal station 1, and has an analog detecting section 4 including elements for detecting a temperature, a smoke density, etc. in the form of an analog amount. Each sensor also has a sampling circuit 5 which samples the analog detection signals with a predetermined period. The sampling data from the sampling circuit 5 is converted into digital data by an A/D converter 6 and supplied to an average calculating section 7.

Figure 2:
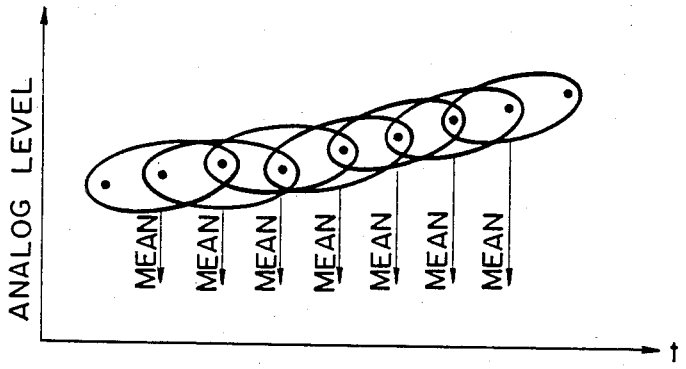
FIG. 2 is an explanatory diagram showing the data averaging calculation of the CPU in FIG. 1.

This average calculating section 7 carries out the moving average calculation and the simple average calculation of the sampling data. More specifically, as shown in FIG. 2, average values (MEAN) of three sequentially obtained sampling data are sequentially calculated and then simple average values of six data obtained by the moving average calculation are calculated to provide one data to be transmitted to the central signal station.

This average calculation processing comprising the moving average calculation and the simple average calculation, functions as a low pass digital filter for eliminating higher harmonic components generated by fundamental frequency components inherent in a fire temperature or smoke contained in the analog detection signals. By this low pass digital filter, original signal can be faithfully reproduced. Further this average calculating section can function as a digital filter by only calculation of the running average.

As the analog detection signals are subjected to sampling, the probability that pulse noises are taken as sampling data is lowered. In addition, even if pulse noises are included in the sampling data, sufficient noise suppression can be effected by the average calculation.

A digital comparator 8 serves as a comparating means which compares the output data from the average calculation section 7 with a sensor threshold value represented by a reference voltage source 9 and generates a H-level output for enabling data transmission when the average calculation data exceeds the sensor threshold value. As the threshold value set for the comparator 8, there can be mentioned, for example, the maximum value of room temperature normally expected, e.g., 30° C., in case of the fire temperature detection. In this case, only when the detection data for 30° C. or more is obtained, will data transmission to the central signal station be allowed.

A calling discriminating section 10 counts clock pulses transmitted from the central signal station 1, for example, in the mode of voltage, and detects a call addressed thereto when the clock count number reaches the number allotted to the sensor and then outputs a data transmitting signal (H-level signal). The outputs from the calling discriminating section 10 and the comparator 8 are input to an AND gate 11. The AND gate 11 provides a H-level output to a signal transmitting section 12 when the detection analog level is higher than the threshold level and the calling discriminating section 10 identifies it is called, and transmitting section 12 transmits to the central signal station 1 the data output from the average calculating section 7, in the current mode, for example, after D/A conversion.

The central signal station 1 comprises a calling control section 13, CPU 14 for carrying out the fire determination processing, an A/D converter for converting the analog signals from the sensors 3 into digital signals, and a display section 16.

The calling control section 13 repeatedly outputs, in the mode of voltage pulses, clock pulses as many as the number of the analog fire sensors 3 connected to the central signal station 1, which are followed by a reset pulse having a long pulse duration to effect sensor polling. The A/D converter 15 is input with a voltage across a resistor 17 generated by the detection current transmitted from the sensors 3 and converts the voltage into a digital signal to provide it to CPU 14.

CPU 14 collects analog data corresponding to the sensor addresses determined by the count numbers of the clock pulses and makes fire determination by the predictive calculation according to the functional approximation as will be described in detail later so as to let the display section 16 display fire indication together with the sensor address.

The fire determination processing on the basis of the sensor data by CPU of the central signal station 1 will now be described.

Figure 3:
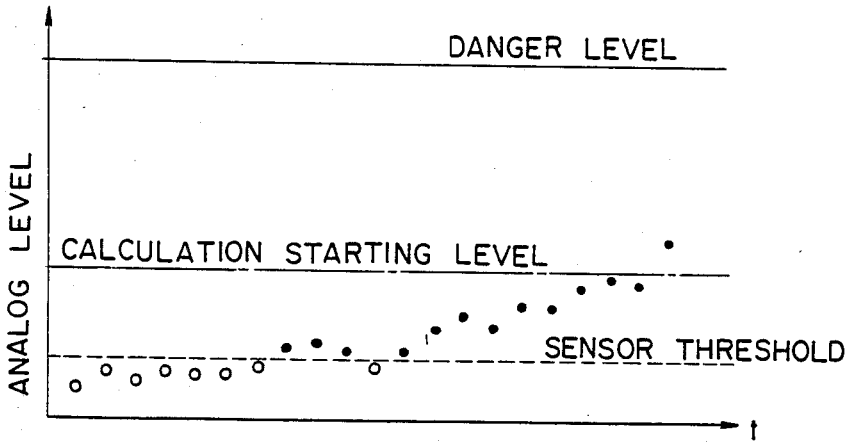
FIG. 3 is an explanatory diagram view showing the relationship between the threshold level of the analog fire sensor and the threshold level used for fire determination by the central signal station.

The contents of the fire determination processing are classified into two as follows:

a. protecting processing for non-fire alarming b. predictive calculation of a fire according to the functional approximation FIG. 3 shows the relationship between the threshold levels used for the fire determinations of a and b supra and the threshold level set for the analog fire sensors 3 for signal transmission control. For fire determination, there is set a calculation starting level for starting the predictive calculation by functional approximation and a danger level for determining, on the basis of the predictive calculation result, the time left before reaching a fire to condition the threshold level of the analog fire sensors is set to a level that eliminates steady noises lower than the calculation starting level.

Therefore, when the detection levels of the analog fire sensors shown as white dots are lower than the threshold level, no signal transmission is carried out even if polling from the central signal station 1 is made. Only when the detection levels of the analog signals are higher than the threshold level, as represented by black dots, are they transmitted to the central signal station 1. Thus, the calculating burden on CPU 14 of the central signal station 1 is reduced by omitting the data represented by white dots.

Figure 4:
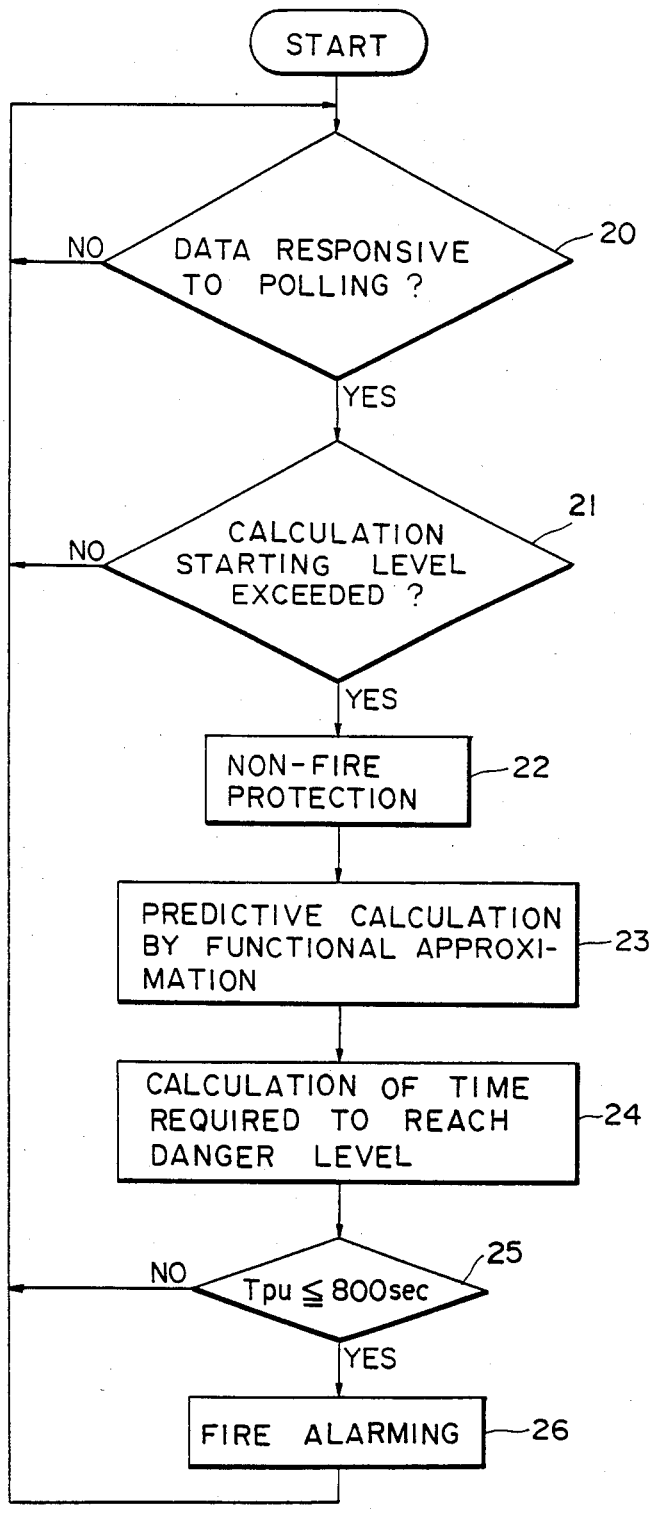
FIG. 4 is a flowchart of the fire determination processing by the CPU of the central signal station.

FIG. 4 is a flowchart of one example of the fire determination processing carried out by CPU 14 of the central signal station 1. In this processing, predictive calculation by functional approximation is carried out.

First, at block 20, it is checked, by polling, if there are sensor response data.

If there are response data, the processing proceeds to the following decision block 21, where it is checked if the latest data transmitted from a polled sensor after it has been subjected to the average calculation, and exceeding the sensor threshold value, is higher than the calculation starting level as shown in FIG. 3.

CPU 14 of the central signal station 1 sequentially stores 20 sensor data LD1 to LD20 for calculation processing by the functional approximation.

If the received latest sensor data LD20 exceeds the calculation starting level, the step proceeds to block 22 for non-fire protecting processing.

Figure 5:
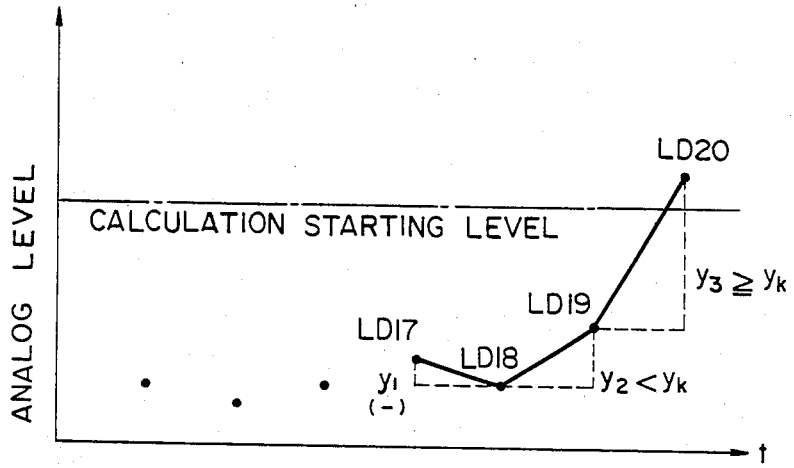
FIGS. 5 and 6 are explanatory diagram showing the non-fire protection processing by the CPU of the central signal station.
Figure 6:
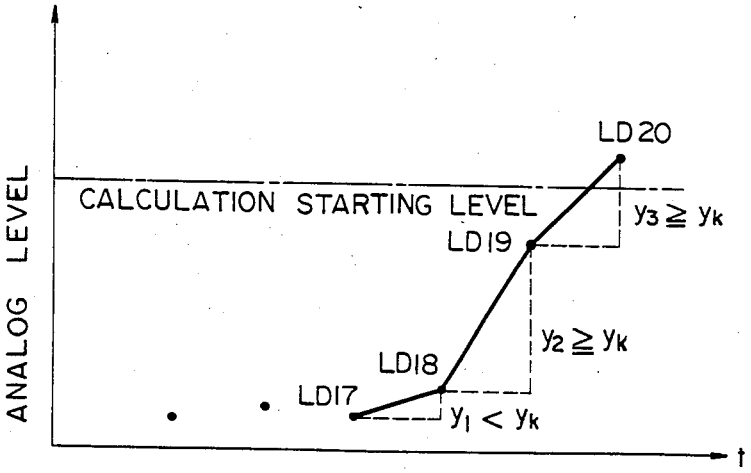

FIG. 5 shows a detection example in which slopes y1 to y3 are shown as examples. In this case, slope y1 is negative and slopes y2 and y3 are positive. As to the positive slopes y2 and y3, it is checked whether they are larger than a predetermined slope yk or not and the number n of the slopes larger than the slope yk is counted. When the number n of the slopes larger than the slope yk is two or more, as shown in FIG. 6, it is determined that there is a possibility of a fire and the processing proceeds to the following step 23 so as to initiate predictive calculation by functional approximation.

On the other hand, as shown in FIG. 5, when the number n of the slopes larger than the slope yk is less than two, it is determined that the cause of the data is due to non-fire smoke caused, for example, by a cigarette, and no predictive calculation by the functional approximation is carried out.

The data passed through the non-fire protection processing at block 22 is subjected to predictive calculation at block 23.

Figure 7:
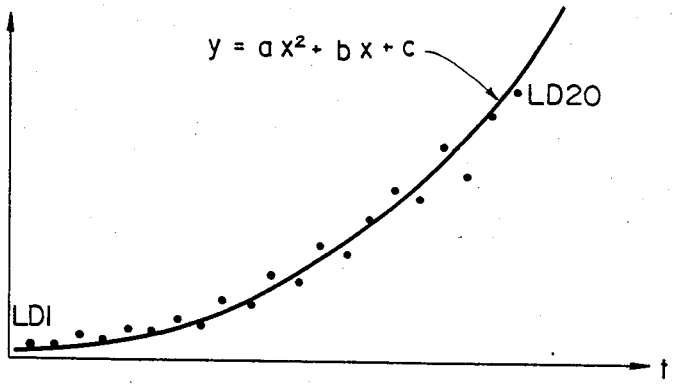
FIG. 7 is an explanatory view of the quadratic functional prediction calculation by the CPU of the central signal station.

In this predictive calculation, a change with time of a temperature or smoke density due to a fire is approximated by:

$$y=ax^2+bx+c$$

in which x is time. The values of the coefficients a, b and c of this quadratic function which is shown in FIG. 7, are obtained from the 20 data LD1 to LD20 provided by the average calculation. The coefficients a, b and c are obtained by solving a set of simultaneous equations comprised of determinants by the method of least squares according to the Gauss-Jordan method.

Figure 8:
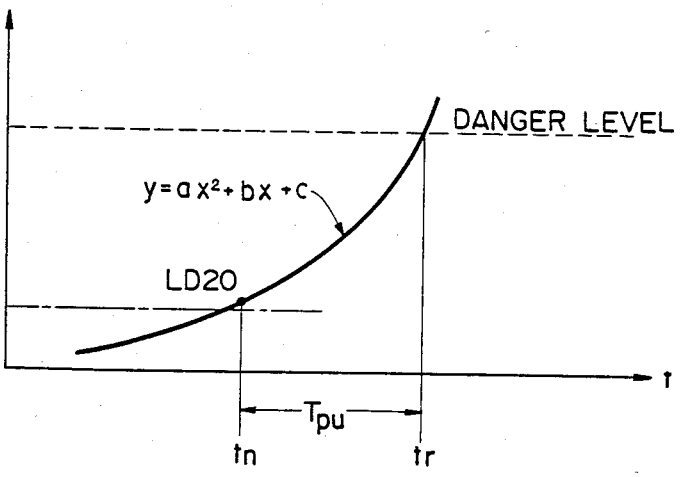
FIG. 8 is an explanatory diagram showing the time required to reach a danger level which is calculated by the CPU of the central signal station.

Once the coefficients a, b and c have been obtained, a locus of future data changes can be entrapulated as shown in FIG. 8.

Therefore, at the following block 24 in FIG. 4, a time tr which is the time required to reach the danger level is obtained on the basis of the quadratic function of FIG. 8 and a predicted time Tpu left at the present time tn to reach the danger level is calculated.

At a decision block 25, since the shorter the time left to reach the danger level the higher the possibility of a real fire, the time Tpu is compared, with a threshold time, for example 800 sec, and if the time is shorter than 800 sec, it is determined as being a fire condition a fire alarm is given at block 26.

As apparent from the foregoing description, the preprocessing calculation by CPU 14 of the central signal station 1 is not needed to be carried out for all of the sensor data. As to signal change within the level range unnecessary to carry out the predictive calculation, the signal transmission to the central signal station 1 is inhibited by the analog fire sensor 3 and only when the change reaches the level which apparently requires determination by the predictive calculation is the signal transmission started. The number of the analog fire sensors 3 which is to be subjected to fire determination by CPU 14 of the central signal station 1 is thereby greatly reduced. Thus, the processing burden on CPU 14 of central signal station 1 is largely reduced and CPU 14 can have a surplus processing, ability, so that the number of the sensors 3 to be connected to the central signal station 1 can be increased.

In this connection, it is to be noted that the sampling circuit 5, the A/D converter 6 and the average calculating section 7 of the analog fire sensor 3 may be omitted. In this case, analog data are directly output as detected by the analog fire sensor section of the analog fire sensor and, the the processing and determination by CPU 14 of the central signal station 1 are as follows:

a. elimination of higher harmonic noised by the average calculation b. protection processing for non-fire alarm c. predictive calculation of a fire by the functional approximation method The predictive calculation by CPU 14 of the central signal station 1 by functional approximation may alternatively be carried out, instead of the quadratic function approximation as described above, by a linear function $y=ax+b$ or may be carried out by a linear function and a quadratic function in combination.

Further, fire determination in the central signal section need not always be done based on functional approximation. It can be determined directly from the analog data if the data have the value to be determined as fire. Also, for data transmission system from each of the analog fire sensor to the central signal station, not only a polling system but also other systems can be employed.

Figure 9:
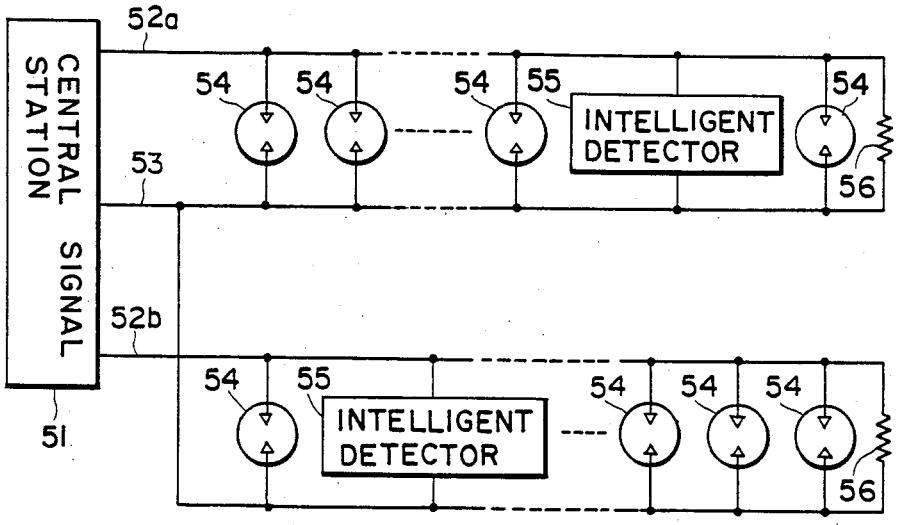
FIG. 9 is a block diagram of a second embodiment of the invention.

FIG. 9 shows the basic form of a second embodiment of the present invention.

This second embodiment differs from the first embodiment in that on-off type detectors are used in place of the analog type detectors in the first embodiment.

The embodiment in FIG. 9 comprises a central signal station 51. A pair of power supply/signal lines comprised of signal lines 52*a*, 52*b* and a common line 53 is provided from the central signal station 51 for each supervisory region, for example a supervisory region on every floor of a building.

Between the signal line 52*a* and the common line 53, a plurality of on-off type fire detectors 54 are connected in parallel with each other for each of the supervisory regions. A terminal resistor 56 is connected at the end of the signal line. Further, at an important site such as a computer room, or a site such as a cooking room where an erroneous alarming is liable to occur included in the region where the signal line 52*a* is provided, an intelligent fire detector 55 is connected between the signal line 52*a* and the common line 53 in parallel in a manner similar to those of the on-off type fire detectors 54. Similar connection of the on-off type fire detectors 54 and the intelligent fire detector 55 is also made for the signal line 52*b*.

The on-off type fire detector 54 closes its switching contacts to short-circuit the signal line 52*a* or 52*b* and the common line 53 to create a low impedance when a detection signal of a change of the physical phenomena caused by a fire, such as a temperature or a smoke density, exceeds the fixed threshold value. The central signal station 51 detects, upon the switching-on of the on-off type fire detector 54, an increase in the current flowing between the signal line 52*a*, 52*b* and the common line 53 and gives a fire alarm.

On the other hand, the intelligent fire detector 55 includes, as will be described in detail later, an analog fire sensor section for detecting a change in a quantity of state, such as a temperature or smoke density, caused by a fire. From the detection signal of the analog fire sensor section it is determined, by predictive calculation processing by a CPU incorporated therein, as to if it is signifies a fire or not. When it is determined as a fire, the signal line 52*a*, 52*b* and the common line 53 are short-circuited into a low impedance by the operation of a switching circuit in a manner similar to that of the on-off type fire detector 54. Then, a fire signal is transmitted to the central signal station 51.

The arrangement of the intelligent fire detector 55 will be described with reference to FIG. 10. An analog fire sensor section 67 detects, in the analog form, a change in the quantity of a state, such as temperature, smoke density, CO gas concentration, etc. caused by a fire. A sampling circuit 57 which samples, with a predetermined period, the analog detection signals from the analog fire sensor section 67. An A/D converter 58 which converts the sampling data into digital data. The fire data converted into the digital data by the A/D converter 58 is supplied to an average calculating section 59.

The average calculating section 59 carries out the moving average calculation and the simple average calculation of the sampling data in a manner similar to that of the average calculating section 7 of the first embodiment in FIG. 1. The steps of the processing are also similar to that of FIG. 2.

Figure 10:
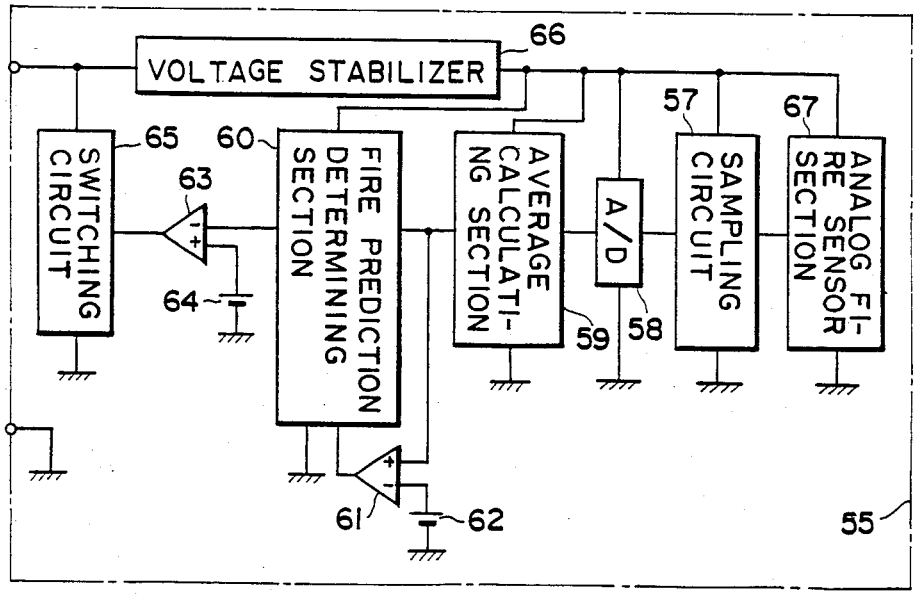
FIG. 10 is a block diagram of an intelligent detector employable in the embodiment of FIG. 9.

In FIG. 10, a fire prediction determining section 60 initiates the prediction calculation, on the basis of a H-level output from a comparator 61, when a predetermined calculation starting level (refer to FIG. 3 of the first embodiment) set by a reference voltage source 62 of the comparator 61, which is input with an output from the average calculating section 59, is exceeded. Further, the fire prediction determining section 60 is always input data from the average calculating section 59 and stores a predetermined number, for example 20 as in the first example, which are renewed in accordance with input of the succeeding data. Also as described above, the computation is started when the comparator output reaches the H-level. The prediction data from the fire prediction determining section 60 is further supplied to a comparator 63. In the comparator 63, a threshold value for determining the prediction data as being a fire is set by a reference voltage source 64. When the prediction data exceeds the threshold level determined by the reference voltage source 64, a fire determination output is generated as a H-level output of the comparator 63.

A switching circuit 65 functions as an interface for connecting the intelligent fire detector 55 to the signal line of the conventional fire alarm system. The switching circuit 65 switches an SCR or the like built therein, when a fire signal is obtained from the fire prediction determining section 60, causing a low impedence short-circuit between the pair of power supply/signal lines derived from the central signal station 51. A voltage stabilizer 66 is supplied with power from the central signal station 51, and applies a predetermined voltage to the analog fire sensor section 67 and the fire prediction determining section 60, etc.

Figure 11:
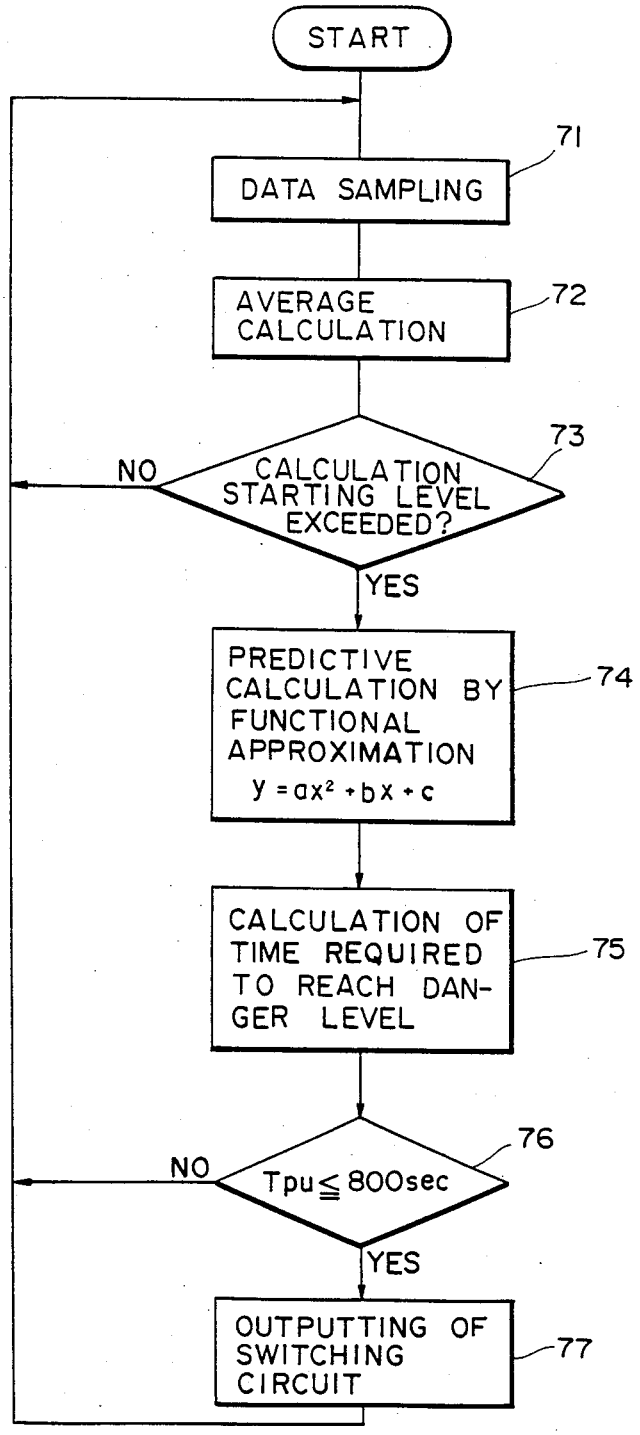
FIG. 11 is a flow chart of the fire determination processing at a fire prediction determining section of FIG. 10.

FIG. 11 is a flowchart of one example of the fire determination processing carried out by the fire prediction determining section 60 provided in the intelligent fire detector. In this flowchart, the predictive calculation processing by the functional approximation is exemplarily shown as in the first embodiment. Although the processing is substantially the same as that of the first embodiment, it will be briefly described in the following.

First, at block 71, the detection signals from the analog fire sensor section 67 are sampled with a predetermined period. After sampling, the average calculation is carried out at the following block 72.

At the following decision block 73, it is checked if the data obtained by the average calculation exceeds the predetermined calculation starting level or not. If the data obtained by the average calculation exceeds the calculation starting level, the predictive calculation by the functional approximation is carried out at block 74. In the present embodiment, the predictive calculation by the quadratic functional approximation is exemplarily described. Of course, the predictive calculation may alternatively be made by the linear functional approximation.

A change with time of the temperature or smoke density due to a fire is approximated by:

$$y=ax^2+bx+c$$

as in the foregoing embodiment to obtain the coefficients a, b and c. Then, the locus of future changes of data is determined as shown in FIG. 7.

Thereafter, the step proceeds to block 75 to calculate a time Tpu required to reach the danger level.

Subsequently, at decision block 76, it is checked whether the time Tpu is shorter than a predetermined dangerous time Td, e.g., 800 sec or not. Since the shorter the predicted time Tpu left to reach the danger level, the more danger the fire is, if the time Tpu is shorter than 800 sec, it is determined as being a fire. The process, then, proceeds to block 77 to operate the switching circuit 9 to transmit a fire signal to the central signal station 51.

Although, in the system of the embodiment in FIG. 10 wherein an analog detector and an on-off detector are used in combination, an intelligent analog detector is employed, it may alternatively be an analog fire sensor 3 as used in the first embodiment. Of course, a central signal station which is able to determine the value of the electric current from the analog fire sensor should be employed.

Figure 12:
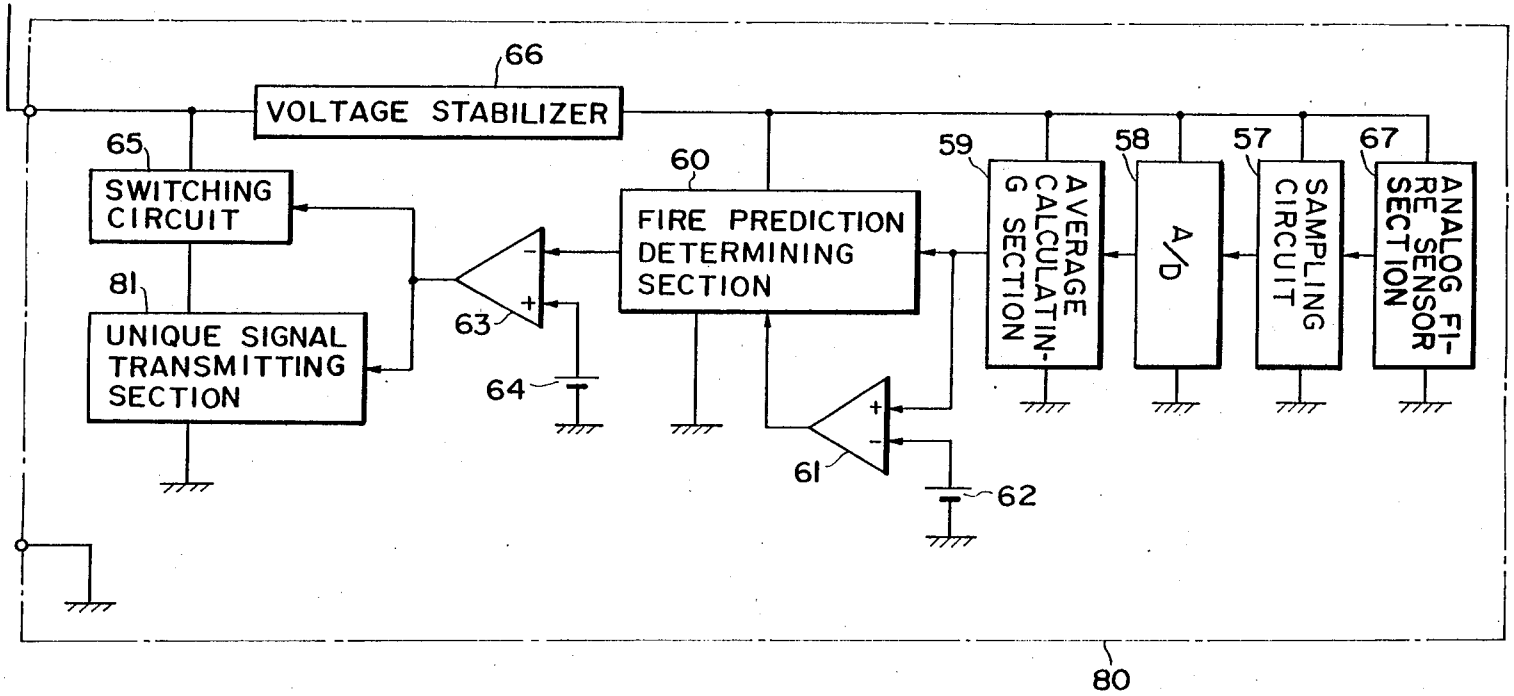
FIG. 12 is a block diagram of another form of the intelligent detector employable in the embodiment of FIG. 9.

FIG. 12 is a block diagram of another form of the intelligent fire detector employable in the present invention. In FIG. 10 the intelligent fire detector simply outputs a fire detection signal, in the on-off form, to the central signal station, whereas in FIG. 12, a unique signal representing an address of the intelligent fire detector 80 may be transmitted.

The analog fire sensor section 67, the fire prediction determining section 60, the switching circuit 65 and the voltage stabilizer 66 are substantially the same as those of FIG. 10, but a unique signal transmitting section 81 is additionally connected in series with the switching circuit 65. The fire determination output from the fire prediction determining section 60 operates not only the switching circuit 65 but also the unique signal transmitting section 81, simultaneously. The unique signal transmitting section 81 transmits a unique signal having a frequency preliminary alloted or an address signal as a code signal to the central signal station. The central signal station receives the fire detection signal transmitted through the switching circuit 65 and simultaneously receives the unique signal to actuate a fire starting display.

Although the fire determination processing is carried out by predictive calculation by functional approximation in the foregoing embodiments, the present invention is not limited thereto and fire determination processing may alternatively be made by other suitable programming.

We claim:

1. A fire detection system for detecting a fire condition in any of a plurality of supervised regions, comprising:

a plurality of sensors respectively located in such regions and which produce analog data corresponding to a physical state relevant to a fire condition, each such sensor transmitting the analog data produced thereby in response to a polling signal received thereby only if such data exceeds a predetermined threshold level; and a central signal station adapted to poll said sensors sequentially and to receive the analog data transmitted thereby, and which makes a predictive calculation of the time remaining until outbreak of a fire on the basis of the analog data so received.

2. A fire detection system as claimed in claim 1, wherein each of said sensors comprises a data signal transmission section for transmitting the analog data and a calling discriminating section which enables the transmission section to transmit the analog data when a polling signal is received from the central signal station.

3. A fire detection system as claimed in claim 1, in which the central signal station comprises a CPU for making the predictive fire calculation, and does not initiate such calculation for analog data received from a sensor unless such data exceeds a predetermined calculation starting level.

4. A fire detection system as claimed in claim 3, in which said sensor threshold level is lower than said calculation starting time.

5. An analog fire sensor for use in a fire detection system as claimed in claim 1, comprising:

an analog sensor section for producing analog data corresponding to the magnitude of a physical state relevant to a fire condition; a comparing section for comparing the value of the analog data output from the analog sensor section with a predetermined sensor threshold level; and a data signal transmission section for transmitting the analog data in response to a polling signal received thereby when such data exceeds said threshold level.

6. An analog fire sensor as claimed in claim 5, further comprising an average calculating section which samples the analog data at a predetermined sampling period and calculates the average value of the sampled data; and wherein said signal transmission section transmits the average sampled data in response to a polling signal only when such average exceeds said predetermined threshold level.

7. An analog fire sensor as claimed in claim 6, wherein said average calculating section sequentially calculates the moving average values of the sampled analog data.

8. An analog fire sensor as claimed in claim 7, wherein said average calculating section further calculates a simple average value from the plural moving average values.

* * * * *